US008435362B2

(12) United States Patent
Nazmy et al.

(10) Patent No.: US 8,435,362 B2
(45) Date of Patent: May 7, 2013

(54) PROCESS FOR PRODUCING A SINGLE-CRYSTAL COMPONENT MADE OF A NICKEL-BASED SUPERALLOY

(75) Inventors: Mohamad Nazmy, Fislisbach (CH); Claus Gerdes, Rütihof (CH); Andreas Künzler, Baden (CH)

(73) Assignee: ALSTOM Technology Ltd., Baden (CH)

( * ) Notice: Subject to any disclaimer, the term of this patent is extended or adjusted under 35 U.S.C. 154(b) by 35 days.

(21) Appl. No.: 13/170,570

(22) Filed: Jun. 28, 2011

(65) Prior Publication Data

US 2012/0000577 A1 Jan. 5, 2012

(30) Foreign Application Priority Data

Jun. 30, 2010 (CH) ..... 1058/10

(51) Int. Cl.
*C21D 11/00* (2006.01)
*C22C 19/03* (2006.01)

(52) U.S. Cl.
USPC ..... 148/508; 148/675; 148/677

(58) Field of Classification Search ..... 148/508, 148/410, 675, 677
See application file for complete search history.

(56) References Cited

U.S. PATENT DOCUMENTS 4,328,045 A 5/1982 Pearson et al.
5,270,123 A 12/1993 Walston et al.
5,820,700 A 10/1998 DeLuca et al.
5,935,353 A 8/1999 Murphy et al.
7,632,362 B2 12/2009 Konter et al.
2002/0124915 A1 9/2002 Kobayashi et al.

FOREIGN PATENT DOCUMENTS

EP 0208645 1/1987

OTHER PUBLICATIONS

Chang, J-C., et al., "Development of Microstructure and Mechanical Properties of a Ni-Base Single-Crystal Superalloy by Hot-Isostatic Pressing," JMEPEG 2003, vol. 12, pp. 420-425, ASM International, Materials Park, OH, US.

Pessah-Simonetti, M., et al., "Effect of a long-term prior aging on the tensile behaviour of a high-performance single crystal superalloy," Journal de Physique IV, Nov. 3, 1993, Colloque C7, supplement au Journal de Physique III, pp. 347-350, Onera, B.P. 72, Chatillon cedex, France.

Search Report for Swiss Patent App. No. 1058/2010 (Oct. 27, 2010).

*Primary Examiner* — Jessee R. Roe

(74) *Attorney, Agent, or Firm* — Cermak Nakajima LLP; Adam J. Cermak

(57) ABSTRACT

In a process for producing a large single-crystal component or directionally solidified component made of a nickel-based superalloy, the component is first cast into shape in a known manner to form a microstructure comprising dendrites, and then solution annealing for homogenizing the cast microstructure of the component and two-stage precipitation heat treatment are carried out. In order to avoid chemical inhomogeneities and internal stresses caused thereby, a HIP process with a pressure of higher than 160 MPa is carried out following the solution annealing.

4 Claims, 3 Drawing Sheets

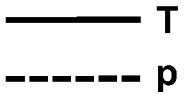
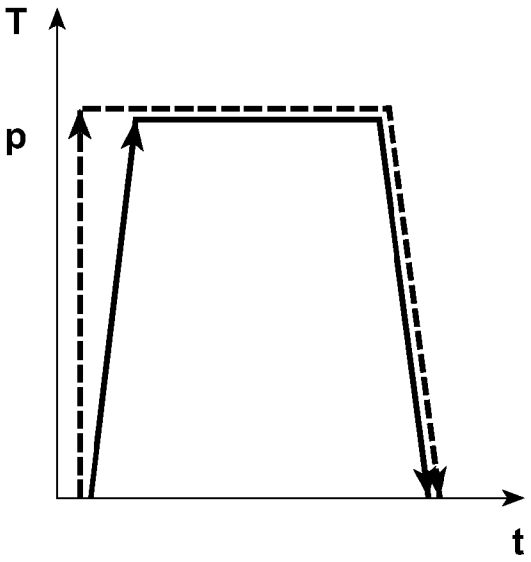
FIG. 3a
FIG. 3b
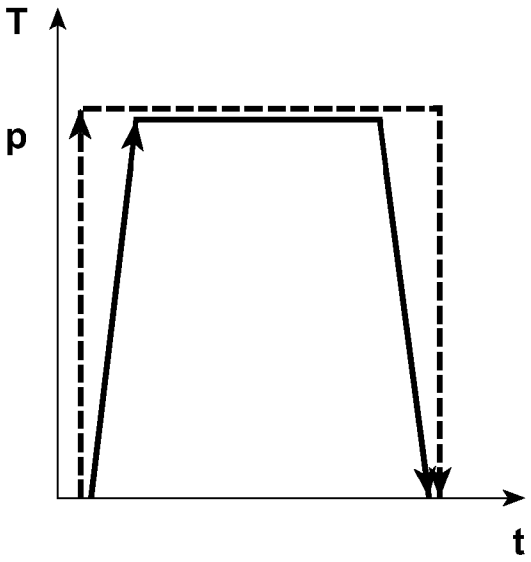
FIG. 3c

PROCESS FOR PRODUCING A SINGLE-CRYSTAL COMPONENT MADE OF A NICKEL-BASED SUPERALLOY

This application claims priority to Swiss application number 01058/10, Switzerland of Jun. 30, 2010, the entirety of which is incorporated by reference herein.

BACKGROUND

1. Field of Endeavor

The invention concerns the field of materials science. It relates to a process for producing a single-crystal component or directionally solidified component which is made of a nickel-based superalloy and has relatively large dimensions. Particularly good properties, in particular a very good fatigue strength with low cyclic loading of the component, can be achieved.

2. Brief Description of the Related Art

At high loading temperatures, single-crystal components made of nickel-based superalloys have, inter alia, very good material strength but also good corrosion and oxidation resistance, as well as a good creep strength. On account of these properties, when using such materials, for example in gas turbines, the intake temperature of the gas turbines can be raised so that the efficiency of the gas turbine system increases.

In simplified terms, there are two types of single-crystal nickel-based superalloys.

The first type, to which the present invention relates, can be fully solution annealed so that the entire γ' phase lies in solution. This is the case, for example, for the known alloy CMSX4 with the following chemical composition (in % by weight): 5.6 Al, 9.0 Co, 6.5 Cr, 0.1 Hf, 0.6 Mo, 3 Re, 6.5 Ta, 1.0 Ti, 6.0 W, remainder Ni; or the alloy PWA 1484 with the following chemical composition (in % by weight): 5 Cr, 10 Co, 6 W, 2 Mo, 3 Re, 8.7 Ta, 5.6 Al, 0.1 Hf; and the known alloy MC2 which, in contrast to the previously mentioned alloys, is not alloyed with rhenium and has the following chemical composition (in % by weight): 5 Co, 8 Cr, 2 Mo, 8 W, 5 Al, 1.5 Ti, 6 Ta, remainder Ni.

A typical standard heat treatment for CMSX4 is, for example, as follows: solution annealing at 1320° C./2 h/shielding gas, rapid cooling with a blower.

The second type of single-crystal nickel-based superalloys is not fully heat treatable, i.e., in this case only a specific part rather than the entire proportion of the γ' phase enters solution during solution annealing. This is the case for example for the known superalloy CMSX186 with the following chemical composition (in % by weight): 0.07 C, 6 Cr, 9 Co, 0.5 Mo, 8 W, 3 Ta, 3 Re, 5.7 Al, 0.7 Ti, 1.4 Hf, 0.015 B, 0.005 Zr, remainder Ni; and the alloy CMSX486 with the following chemical composition (in % by weight): 0.07 C, 0.015 B, 5.7 Al, 9.3 Co, 5 Cr, 1.2 Hf, 0.7 Mo, 3 Re, 4.5 Ta, 0.7 Ti, 8.6 W, 0.005 Zr, remainder Ni.

The nickel-based superalloys of the second type are usually exposed to a two-stage heat treatment (aging process at lower temperatures) since at higher temperatures, such as are typically used for solution annealing the alloys of the first type, the melting point initiation temperature is already reached and the alloy therefore undesirably begins to melt.

A typical two-stage heat treatment of the alloy CMSX186 is for example as follows:

$1^{st}$ stage: 1080° C./4 h/blower $2^{nd}$ stage: 870° C./20 h/blower.

The creep strength of the first type of nickel-based superalloys is normally higher than that of the second type, assuming that the alloys belong to the same generation. This is primarily due to the fact that the dissolved γ' is the main source of the achievable strength.

Nickel-based superalloys for single-crystal components, as are known for example from U.S. Pat. No. 4,643,782, EP 0 208 645, U.S. Pat. No. 5,270,123, and U.S. Pat. No. 7,115,175 B2, contain alloying elements which strengthen the solid solution, for example Re, W, Mo, Co, Cr, and elements which form γ' phases, for example Al, Ta and Ti. The level of high-melting alloying elements (W, Mo, Re) in the basic matrix (austenitic γ phase) increases continuously as the loading temperature of the alloy increases. For example, standard nickel-based superalloys for single crystals contain 6-8% W, up to 6% Re and up to 2% Mo (in % by weight). Furthermore, small proportions of C, B, Hf and Zr are often present. The alloys disclosed in the abovementioned documents have a high creep strength, relatively good LCF (low cycle fatigue) and HCF (high cycle fatigue) properties and a high resistance to oxidation.

These known alloys were developed for aircraft turbines and were therefore optimized for short-term and medium-term use, i.e., the load time was designed for up to 20 000 hours. By contrast, industrial gas turbine components have to be designed for a load time of up to 75 000 hours or even more.

By way of example, after a load time of 300 hours, the alloy CMSX-4, which is known from U.S. Pat. No. 4,643,782, when it was tested for use in a gas turbine at a temperature of over 1000° C., underwent considerable coarsening of the γ' phase, which disadvantageously leads to an increase in the creep rate of the alloy.

It is known prior art to subject superalloys of this type to heat treatment after the casting process, in which heat treatment, in a first solution annealing step, the γ' phase, which is precipitated non-uniformly during the casting process, is completely or partially dissolved in the microstructure. In a second heat-treatment step, this phase is precipitated in a controlled manner again. In order to obtain optimal properties, this precipitation heat treatment is carried out in such a way that the finest possible uniformly distributed particles of the γ' phase are produced in the γ phase (=matrix).

However, it has been found that directional coarsening of the γ' particles, the phenomenon known as rafting, disadvantageously occurs in the microstructure of alloys of this type if a mechanical load is present with long-term high-temperature loading (creep loading), or after plastic deformation of the material at room temperature, which is followed by heat treatment (high-temperature annealing) of the material. At high γ' contents (i.e., at a γ' content of at least 50% by volume), the microstructure is thereby inverted, i.e., γ' becomes the continuous phase in which what was previously the γ matrix is embedded.

Since the intermetallic γ' phase tends toward environmental embrittlement, under certain loading conditions this subsequently leads to a massive drop in the mechanical properties—in particular the yield strength—at room temperature (25° C.) compared to samples which were not subjected to such prior creep loading. This impairment of the yield strength is described by the term "degradation" of the properties (see Pessah-Simonetti, P. Caron and T. Khan: Effect of long-term prior aging on tensile behaviour of high-performance single crystal superalloy, Journal de Physique IV, Colloque C7, Volume 3, November 1993).

A similar effect which leads to the rafting of the γ' phase also arises during the solidification of nickel-based superalloys on account of dendritic segregations. Particularly in superalloys with a high proportion of elements which diffuse slowly, e.g. rhenium, the segregations of these elements cannot be eliminated fully within an acceptable homogenization time. Since the γ' phase which precipitates during the cooling has a smaller lattice constant than the γ matrix, but the γ/γ' lattice offset in the dendrites is greater than in the interdendritic areas, internal stresses are formed during the heat treatment, in particular during the cooling. This results in a change in the γ' microstructure, in that the initially cubic form of γ' changes into an elongate form of γ'. This is accompanied by the impairment of mechanical properties, e.g. the low cycle fatigue strength.

A further problem of many known nickel-based superalloys, for example the alloys which are known from U.S. Pat. No. 5,435,861, is that in the case of large components, e.g. gas turbine blades or vanes with a length of more than 80 mm, the casting properties leave something to be desired.

The casting of a perfect, relatively large directionally solidified single-crystal component from a nickel-based superalloy is extremely difficult. Most of these components have defects, e.g., small-angle grain boundaries, freckles (i.e., defects caused by a series of identically directed grains with a high eutectic content), equiaxed limits of variation, microporosities, etc. These defects weaken the components at high temperatures, and consequently the desired service life and operating temperature of the turbine are not achieved.

However, since a perfectly cast single-crystal component is extremely expensive, the industry tends to permit as many defects as possible without the service life or operating temperature being adversely affected.

Another possibility is proposed in U.S. Pat. No. 7,115,175 B2: after the single-crystal component has been cast, the microporosities present, which were produced during the casting, are closed and eutectic γ/γ' phase islands in the matrix are partially dissolved, in that a HIP (hot isostatic pressing) process is employed, then solution annealing for completely dissolving the eutectic γ/γ' phase and for precipitating uniformly distributed large γ' particles (referred to as octet shaped) is performed, and then precipitation heat treatment is carried out in order to obtain second and uniformly distributed fine cuboidal γ' particles. This is intended to increase the strength of the superalloy.

According to the process described in U.S. Pat. No. 7,115,175 B2, the HIP process, which directly follows the casting step, is carried out after slow, two-stage heating of the cast object at a final HIP temperature in the range of 1174° C. (2145° F.) to 1440° C. (2625° F.), where the holding time is 3.5 to 4.5 hours and the pressure is in the range of 89.6 MPa (13 ksi) to 113 MPa (16.5 ksi), i.e., is relatively low.

This known process therefore produces single-crystal components made of nickel-based superalloys which are advantageously pore-free and have no eutectic γ/γ' phases and have a γ' morphology with a bimodal γ' distribution.

It is not possible to positively influence the microstructure with respect to the undesirable rafting described above with the process disclosed in U.S. Pat. No. 7,115,175 B2.

SUMMARY

One of numerous aspects of the invention is based on a process for producing, including heat treatment, relatively large single-crystal components or components having a directionally solidified microstructure which are made of known nickel-based superalloys, with which process it is possible to establish a microstructure which does not tend toward rafting of the γ' phase and therefore leads to improved mechanical properties, in particular an improved low cycle fatigue strength (LCF), of the components.

According to another aspect of the invention, the following steps are carried out after the component has been cast according to conventional prior art:

A) the dendrite arm spacing (λ) is determined in various regions of the cast component, B) the slowest diffusion element in the composition of the respective nickel-based superalloy is identified in order to determine the diffusion coefficient (D), C) the time (t) required to reduce the segregation of this slowest diffusion element to ≦5% at a solution annealing temperature ($T_1$), which is lower than the initiation melting temperature ($T_{mi}$) but is high enough to lie in the required heat treatment window, is calculated, D) the cast component is solution annealed, including heating the component to the solution annealing temperature ($T_1$), holding the component at this temperature for the time (t) calculated in step C), and chilling from the solution annealing temperature ($T_1$) to room temperature (RT) at a rate (v1) of ≧50° C./min, E) the two-stage precipitation treatment is carried out in order to precipitate the γ' phase at, in each case, lower temperatures ($T_2$) and ($T_3$) following step D), wherein, in the first stage of the precipitation treatment, a HIP process with a pressure (p) of higher than 160 MPa at the holding temperature ($T_2$) and subsequent cooling to room temperature (RT) at a cooling rate (v2) of ≧50° C./min is carried out, and, in the subsequent, second stage of the precipitation treatment, the component is subjected to heat treatment at a holding temperature ($T_3$) with subsequent cooling to room temperature (RT) at a cooling rate (v3) of 10 to 50° C./min.

Processes embodying principles of the present invention make it possible to produce large single-crystal components or components having a directionally solidified microstructure which are made of known nickel-based superalloys, which are pore-free and have a microstructure with which the rafting of the γ' phase is avoided. Therefore, the components produced in this way have improved mechanical properties, in particular an improved low cycle fatigue strength (LCF), and have the advantage that they can be carried out relatively easily.

It is advantageous if the dendrite arm spacing (λ) as per step A) is determined metallographically. This is relatively simple to realize and may already take place, for example, prior to the process on the basis of appropriate samples.

Furthermore, it is advantageous if the chilling rate (v1) from solution annealing temperature ($T_1$) to room temperature is more than 70° C./min, because extremely fine uniformly distributed γ' particles are then obtained in the γ matrix.

Finally, it is advantageous if the process according to the invention for producing a component made of a nickel-based superalloy having the following chemical composition (in % by weight): 5.6 Al, 9.0 Co, 6.5 Cr, 0.1 Hf, 0.6 Mo, 3 Re, 6.5 Ta, 1.0 Ti, 6.0 W, remainder Ni, is carried out with the following treatment parameters:

solution annealing at 1290-1310° C./4-6 h/rapid cooling where v1 is ≧50° C./min, HIP process (isostatic pressure >160 MPa) with heating and annealing at 1150° C./4-8 h/rapid cooling where v2 is ≧50° C./min, annealing at 870° C./16-20 h/cooling where v3 is in the range of 10-20° C./min.

BRIEF DESCRIPTION OF THE DRAWINGS

The drawing shows an exemplary embodiment of the invention.

DETAILED DESCRIPTION OF EXEMPLARY EMBODIMENTS

In the description which follows, the invention is explained in more detail with reference to an exemplary embodiment and the drawings.

A large single-crystal component/directionally solidified component was produced using the nickel-based superalloys CMSX4, known from the prior art, having the following chemical composition (in % by weight): 5.6 Al, 9.0 Co, 6.5 Cr, 0.1 Hf, 0.6 Mo, 3 Re, 6.5 Ta, 1.0 Ti, 6.0 W, remainder Ni.

The component, for example a gas turbine blade or vane, was first cast into its shape. During the solidification of this cast alloy, dendritic segregations are produced on account of the composition, in particular the relatively high Re content.

Rhenium is an element which diffuses very slowly, and therefore these segregations cannot be eliminated fully within an acceptable homogenization time during the subsequent solution annealing process. Since the γ' phase which precipitates during the cooling has a smaller lattice constant than the γ matrix, but the γ/γ' lattice offset in the dendrites is greater than in the interdendritic areas, internal stresses are formed during the heat treatment, in particular during the cooling. This results in degradation in the γ' microstructure, in that the initially cubic form of γ' changes into an elongate form of γ'. This is accompanied by the impairment of mechanical properties, e.g., the low cycle fatigue strength.

In order to avoid this, the dendrite arm spacing λ, is therefore firstly determined in various regions, for example the critical regions, of the cast component. By way of example, this can be effected metallographically, in which case this spacing may already be determined prior to the process on the basis of appropriate pre-cast samples.

Furthermore, the slowest diffusion element in the composition of the respective nickel-based superalloy is identified in order to determine the diffusion coefficient D. In the present case, this element is rhenium, as already mentioned above. In the case of the nickel-based superalloy MC2 described above in the section entitled "Background of the invention", this element is Mo.

The data which is now known, i.e., D and λ, is used to calculate the required time t for which the component has to be held at solution annealing temperature $T_1$, which is lower than the initiation melting temperature $T_{mi}$ but is high enough to lie in the required heat treatment window, so that the microsegregation of the slowest diffusion element is reduced to ≧5%.

In the present exemplary embodiment, this calculated time t is 4-6 h at a solution annealing temperature $T_1$ of 1290-1310° C. This time can be determined using the following formula:

$$t=\lambda^2 \ln \delta/4\pi^2 D$$

where

λ=dendrite arm spacing

D=diffusion coefficient (of Rh into Ni for the present example)

δ=amplitude of the microsegregation (here: 0.05 for a residual segregation of 5%).

Figure 1:
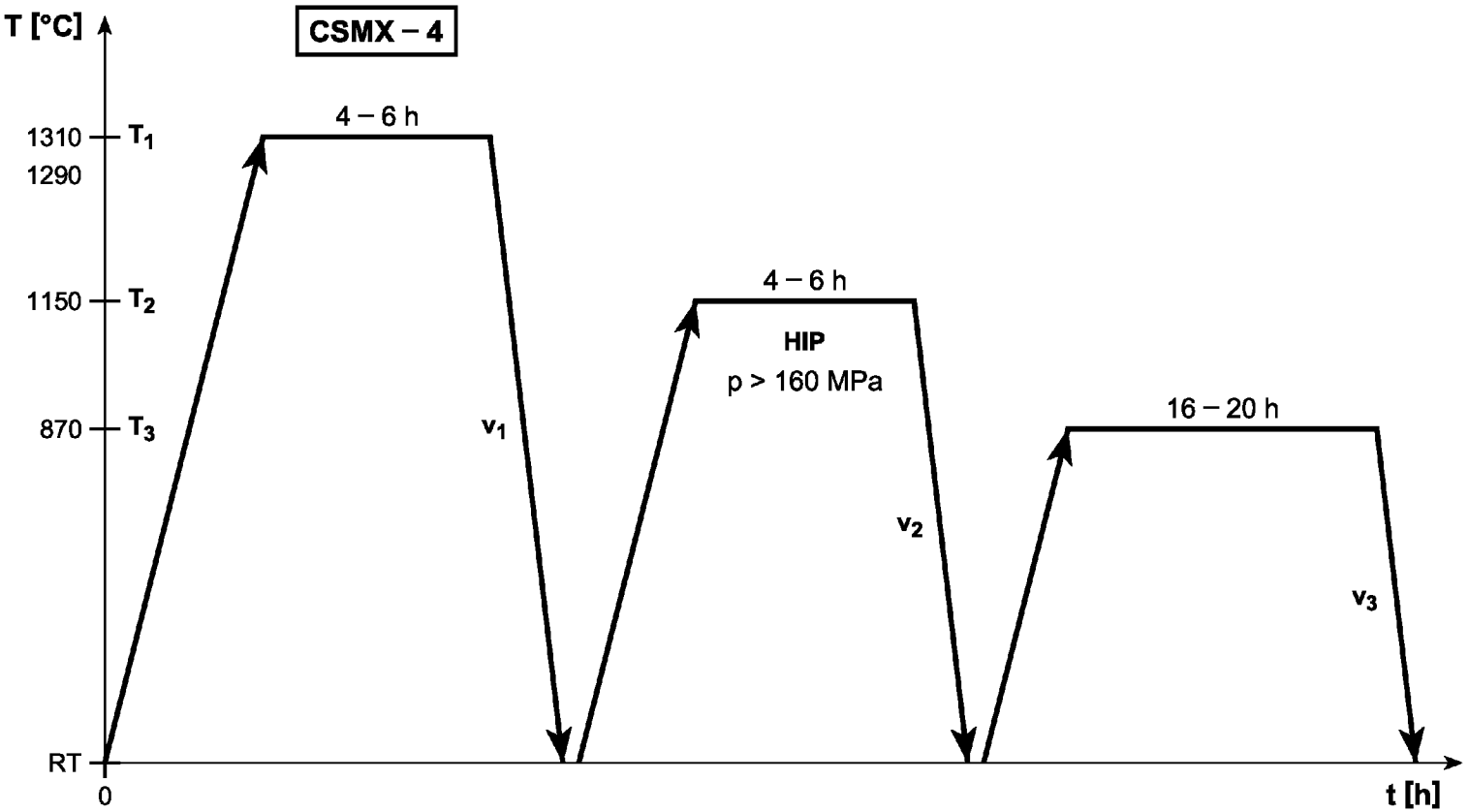
FIG. 1 schematically shows the time-temperature graph for the treatment process, which follows the casting process, for producing a single-crystal component.

FIG. 1 schematically shows the time-temperature graph for the treatment process, which follows the casting process, for producing the single-crystal component made of the superalloy mentioned above.

Figure 2C:
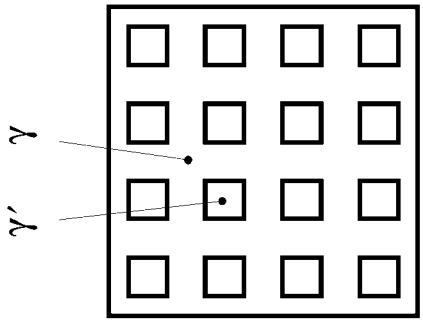
FIGS. 2*a*-2*c* schematically show the respective microstructure appropriate to FIG. 1 (<001> orientation), and FIGS. 3*a*-3*c* schematically show the time-temperature and pressure-temperature graphs for the HIP process in three possible variants.
Figure 2B:
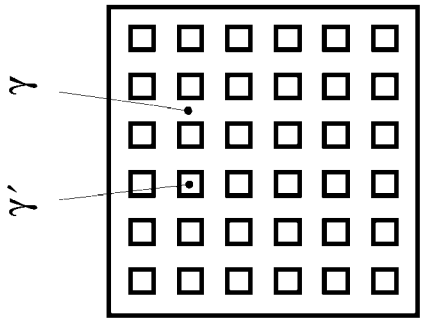
Figure 2A:
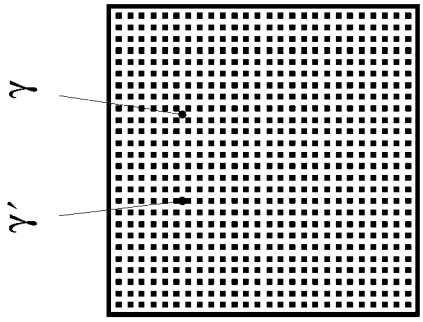

In the present exemplary embodiment, the solution annealing (process step D)) of the cast component therefore includes heating the component to the above-mentioned solution annealing temperature $T_1$ of 1290-1310° C., holding the component at this temperature for the time t (4-6 h) calculated above, and rapid chilling from the solution annealing temperature $T_1$ to room temperature at a rate v1 of ≧50° C./min, in order to obtain very fine uniformly distributed γ' particles in the γ matrix after the chilling (see FIG. 2*a* for a schematic illustration of the microstructure). The chilling rate is preferably greater than 70° C./min, because a microstructure with extremely fine, uniformly distributed γ' particles in the γ matrix is then obtained.

The solution annealing is followed by two-stage precipitation treatment in order to precipitate the γ' phase at, in each case, lower temperatures $T_2$ and $T_3$ compared to $T_1$ (process step E)), wherein, in the first stage of the precipitation treatment, a HIP process with a pressure p of higher than 160 MPa and a cooling rate v2 of ≧50° C./min is employed. In the present exemplary embodiment, the final temperature of the HIP process is 1150° C., and the holding time is 4-6 h. The final pressure applied during the HIP process is relatively high: it is greater than the internal stresses brought about by the inhomogeneities in the microstructure. This process step advantageously closes micropores possibly present in the microstructure and eliminates stresses brought about by the rapid cooling from solution annealing temperature $T_1$ to room temperature or by residual inhomogeneities possibly present in the microstructure. This prevents directional rafting of the γ' phase since the cubic γ' particles which have already been mentioned are formed in the γ matrix. The microstructure present following the HIP treatment step is fine uniformly distributed cubic γ' particles in the γ matrix and is shown schematically in a <001> orientation in FIG. 2*b*.

The first stage of process step D) can be realized in a plurality of variants. Corresponding time-temperature and pressure-temperature graphs for the HIP process are shown schematically in FIGS. 3*a*) to 3*c*).

In the first variant, shown in FIG. 3*a*, the temperature and the pressure are virtually identical as a function of the time, i.e., both the isostatic pressure p acting on the component and the temperature T increase linearly with time during the heating phase until the temperature $T_2$ and the isostatic pressure p>160 MPa, i.e., the final isostatic pressure, are reached. Once these parameters have been held for a specific period of time, the values decrease linearly again in the case of both parameters as a function of the time.

In contrast to FIG. 3*a*, in the variant shown in FIG. 3*b*, the final isostatic pressure is applied abruptly with a phase shift immediately once the first stage of process step D) has started, and is also kept constant during the heating phase. All other parameters here are similar to those in FIG. 3*a*.

Finally, it is also possible, in a further variant, to carry out the first stage of process step D), i.e., the HIP process, as shown in FIG. 3*c*. Here, in turn, the final isostatic pressure p is applied abruptly immediately once the heating phase has begun, and is kept constant over the entire heating phase, the holding phase at $T_2$ and additionally also over the entire cooling phase. Only once the component is at room temperature is the isostatic pressure load taken away abruptly.

Rafting in the microstructure is advantageously prevented with all three variants.

Finally, as the last step of the process, a further stage of the precipitation heat treatment of the component is carried out. According to the present exemplary embodiment, here the single-crystal component/directionally solidified component is heated to a temperature $T_3$ of 870° C., held at this temperature $T_3$ for 16-20 h and then cooled to room temperature at a cooling rate v3 of about 50° C./min.

The final microstructure, which is formed after this last treatment step, is shown schematically for the <001> orientation in FIG. 2*c*.

Processes embodying principles of the present invention primarily eliminate chemical inhomogeneities between dendritic and interdendritic regions in the microstructure, thereby reduce or prevent the tendency toward local rafting of the γ' phase (in the present exemplary embodiment, the rafting of the γ' phase could be prevented in the cooling passages of the gas turbine blade or vane), and thus improve the properties of the components, in particular the low cycle fatigue properties.

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A process for producing a single-crystal component or directionally solidified component made of a nickel-based superalloy, from a component which has been cast into shape to form a microstructure having dendrites, the process comprising:

A) determining the dendrite arm spacing (λ) in various regions of the component;

B) identifying the slowest diffusion element in the composition of the nickel-based superalloy and determining the diffusion coefficient (D);

C) calculating the time (t) required to reduce the segregation of said slowest diffusion element to ≦5% at a solution annealing temperature ($T_1$) which is lower than the initiation melting temperature ($T_{mi}$);

D) solution annealing the component, comprising heating the component to the solution annealing temperature ($T_1$), holding the component at said solution annealing temperature ($T_1$) for the time (t) calculated in step C), and chilling from the temperature ($T_1$) to room temperature (RT) at a rate (v1) of ≧50° C./min; and E) two-stage precipitation treating to precipitate the γ' phase at in each case lower temperatures ($T_2$) and ($T_3$) following step D), including, in a first stage of the two-stage precipitation treating, performing a HIP process with an isostatic pressure (p) of higher than 160 MPa at the holding temperature ($T_2$) and subsequently cooling from the temperature ($T_2$) to room temperature (RT) at a cooling rate (v2) of ≧50° C./min, and, in a subsequent, second stage of the two-stage precipitation treatment, subjecting the component to heat treatment at a holding temperature ($T_3$) with subsequent cooling from the temperature ($T_3$) to room temperature (RT) at a cooling rate (v3) of 10 to 50° C./min.

2. The process as claimed in claim 1, wherein determining the dendrite arm spacing (λ) comprises determining metallographically.

3. The process as claimed in claim 1, wherein the chilling rate (v1) in step D) is >70° C./min.

4. The process as claimed in claim 1, wherein:

the nickel-based superalloy has the following chemical composition (in % by weight): 5.6 Al, 9.0 Co, 6.5 Cr, 0.1 Hf, 0.6 Mo, 3 Re, 6.5 Ta, 1.0 Ti, 6.0 W, remainder Ni; and said solution annealing is performed with 1290-1310° C./4-6 h/rapid cooling, where v1 is >50° C./min;

said first stage of the two-stage precipitation treating comprises a HIP process with an isostatic pressure (p) of >160 MPa at a holding temperature ($T_2$) of 1150° C. and a holding time of 4-8 h; and said second stage of the two-stage precipitation treating comprises heating and holding at 870° C./16-20 h/.

* * * * *